US007762337B2

(12) United States Patent
Papon et al.

(10) Patent No.: US 7,762,337 B2
(45) Date of Patent: Jul. 27, 2010

(54) RISER PIPE WITH AUXILIARY LINES MOUNTED ON JOURNALS

(75) Inventors: Gérard Papon, Les Essarts le Roi (FR); Jean Guesnon, Chatou (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 0 days.

(21) Appl. No.: 12/089,243

(22) PCT Filed: Oct. 4, 2006

(86) PCT No.: PCT/FR2006/002293

§ 371 (c)(1),
(2), (4) Date: Sep. 12, 2008

(87) PCT Pub. No.: WO2007/039686

PCT Pub. Date: Apr. 12, 2007

(65) Prior Publication Data

US 2009/0050330 A1 Feb. 26, 2009

(30) Foreign Application Priority Data

Oct. 4, 2005 (FR) ..... 05 10098

(51) Int. Cl.
*E21B 29/12* (2006.01)
*E21B 7/12* (2006.01)

(52) U.S. Cl. ..... 166/345; 166/367; 166/352; 285/142.5; 285/118

(58) Field of Classification Search ..... 166/355, 166/350–352, 367; 285/142.5, 118
See application file for complete search history.

(56) References Cited

U.S. PATENT DOCUMENTS

| | | | | | |
|---|---|---|---|---|---|
| 1,985,963 | A | * | 1/1935 | Walker | 285/12 |
| 2,726,881 | A | * | 12/1955 | Howard | 285/118 |
| 3,189,098 | A | * | 6/1965 | Haeber | 166/352 |
| 3,466,062 | A | * | 9/1969 | Deplante | 285/145.2 |
| 3,851,672 | A | * | 12/1974 | De Vincent et al. | 138/106 |
| 4,043,575 | A | * | 8/1977 | Roth | 285/90 |
| 4,078,605 | A | * | 3/1978 | Jones | 166/359 |
| 4,097,069 | A | * | 6/1978 | Morrill | 285/84 |
| 4,280,719 | A | | 7/1981 | Daniel et al. | |
| 4,330,140 | A | * | 5/1982 | Hampton | 285/39 |

(Continued)

FOREIGN PATENT DOCUMENTS

| | | |
|---|---|---|
| FR | 2 432 672 | 2/1980 |

(Continued)

*Primary Examiner*—Thomas A Beach
(74) *Attorney, Agent, or Firm*—Antonelli, Terry, Stout & Kraus, LLP.

(57) ABSTRACT

The invention relates to a riser pipe section comprising a main tube (2), at least one auxiliary line element (3) substantially parallel to said main tube (2) and at least two fastening means (7, 8) that connect the ends of said element (3) to main tube (2). The section is characterized in that fastening means (7, 8) allow longitudinal stresses to be transmitted from said element (3) to main tube (2) and in that at least one of fastening means (7, 8) allows at least a rotating motion of said element (3) in relation to said main tube (2), the rotating motion following an axis perpendicular to the plane passing through axis (4) of the main tube and through the axis of auxiliary line element (3).

12 Claims, 3 Drawing Sheets

U.S. PATENT DOCUMENTS

| | | | | | |
|---|---|---|---|---|---|
| 4,397,357 | A | | 8/1983 | Hettinger | |
| 4,423,983 | A | | 1/1984 | Dadiras et al. | |
| 4,496,173 | A | * | 1/1985 | Roche et al. | 285/24 |
| 4,514,254 | A | | 4/1985 | Klepner | |
| 4,662,785 | A | * | 5/1987 | Gibb et al. | 405/195.1 |
| 4,712,620 | A | * | 12/1987 | Lim et al. | 166/355 |
| 4,836,581 | A | * | 6/1989 | Guilloteau | 285/31 |
| 5,220,961 | A | * | 6/1993 | Guesnon et al. | 166/367 |
| 5,657,823 | A | * | 8/1997 | Kogure et al. | 166/340 |
| 6,330,918 | B1 | * | 12/2001 | Hosie et al. | 166/341 |
| 6,401,825 | B1 | * | 6/2002 | Woodrow | 166/350 |
| 6,415,867 | B1 | * | 7/2002 | Deul et al. | 166/367 |
| 6,419,277 | B1 | * | 7/2002 | Reynolds | 285/123.1 |
| 6,530,430 | B2 | * | 3/2003 | Reynolds | 166/346 |
| 6,837,311 | B1 | * | 1/2005 | Sele et al. | 166/353 |
| 6,869,253 | B2 | * | 3/2005 | Biolley | 405/224.3 |
| 7,210,531 | B2 | * | 5/2007 | van Belkom et al. | 166/367 |
| 7,568,861 | B2 | * | 8/2009 | Godoy et al. | 405/211 |
| 2008/0012307 | A1 | * | 1/2008 | Taillon | 285/282 |

FOREIGN PATENT DOCUMENTS

| | | |
|---|---|---|
| FR | 2 464 426 | 3/1981 |
| FR | 2 526 517 | 11/1983 |
| FR | 2 799 789 | 4/2001 |
| FR | 2 828 121 | 2/2003 |
| FR | 2 828 262 | 2/2003 |

* cited by examiner

RISER PIPE WITH AUXILIARY LINES MOUNTED ON JOURNALS

FIELD OF THE INVENTION

The present invention relates to the field of very deep sea drilling and oil field development. It concerns a riser pipe element comprising at least one line, or auxiliary line, integrated in the main tube.

BACKGROUND OF THE INVENTION

A riser pipe is made up of an assembly of tubular elements whose length ranges between 15 and 25 m, assembled by connectors. These risers suspended in sea can be very heavy, which requires suspension means of very high capacity at the surface and suitable dimensions for the main tube and the linking subs.

So far, the auxiliary lines: kill lines, choke lines, booster lines and hydraulic lines are arranged around the main tube and they comprise subs that fit together, fastened to the riser element connectors in such a way that these high-pressure lines can allow a longitudinal play between two successive line elements, without any disconnection possibility however. Owing to these elements mounted sliding into one another, the lines intended to allow high-pressure circulation of an effluent coming from the well or from the surface cannot take part in the longitudinal mechanical strength of the structure consisting of the entire riser.

Now, in the perspective of drilling at water depths that can reach 3500 m or more, the dead weight of the auxiliary lines becomes very penalizing. This phenomenon is increased by the fact that, for the same maximum working pressure, the length of these lines requires a larger inside diameter considering the necessity to limit pressure drops.

Document FR-2,799,789 aims to involve the auxiliary lines, kill lines, choke lines, booster lines or hydraulic lines, in the longitudinal mechanical strength of the riser. According to this document, a riser pipe element comprises a main tube, connecting means at both ends thereof, at least one auxiliary line length arranged substantially parallel to the main tube. The auxiliary line length is secured at both ends to the main tube connecting means so that the longitudinal mechanical stresses undergone by the connecting means are distributed in the tube and in the line.

One difficulty in making the riser according to document FR-2,799,789 lies in the fastening means for joining the auxiliary line length to the main tube. The tensional stresses undergone by the auxiliary line are applied to these fastening means. The assembly and design requirements impose a distance to be provided between the main tube and the auxiliary line. This distance acts as a lever arm for the tensional stresses undergone by the auxiliary line. As a result of the tensional stresses associated with the lever arm, the fastening means are subject to bending strains that may be harmful to the good working order of the riser.

The present invention provides a particular embodiment for assembling the auxiliary lines and the main tube in such a way that an auxiliary line length contributes, together with the main tube, to taking up the longitudinal stresses applied to the riser pipe.

SUMMARY OF THE INVENTION

In general terms, the invention relates to a riser pipe section comprising a main tube, at least one auxiliary line element substantially parallel to said main tube, and at least two fastening means joining the ends of said element to the main tube. According to the invention, the fastening means allow longitudinal stresses to be transmitted from said element to the main tube and at least one of the fastening means allows at least a rotating motion of said element in relation to said main tube, the rotating motion following an axis perpendicular to the plane passing through the axis of the main tube and through the axis of the auxiliary line element.

According to the invention, each of the two fastening means can allow at least a rotating motion of the auxiliary line element in relation to said main tube, the rotating motion following an axis perpendicular to the plane passing through the axis of the main tube and through the axis of the auxiliary line element. One of the fastening means can consist of a knuckle joint or of a pivot joint.

The fastening means can comprise a fork secured to the main tube, the fork comprising two bearings, the auxiliary line element comprising two coaxial shafts co-operating with said two bearings.

According to the invention, the main tube can be a steel tube hooped by composite reinforcing strips. The auxiliary line element can be a steel tube hooped by composite reinforcing strips.

The composite reinforcing strips can be made of glass fibers, carbon fibers or aramid fibers coated with a polymer matrix.

BRIEF DESCRIPTION OF THE FIGURES

Other features and advantages of the invention will be clear from reading the description hereafter, with reference to the accompanying figures wherein.

DETAILED DESCRIPTION

Figure 1:
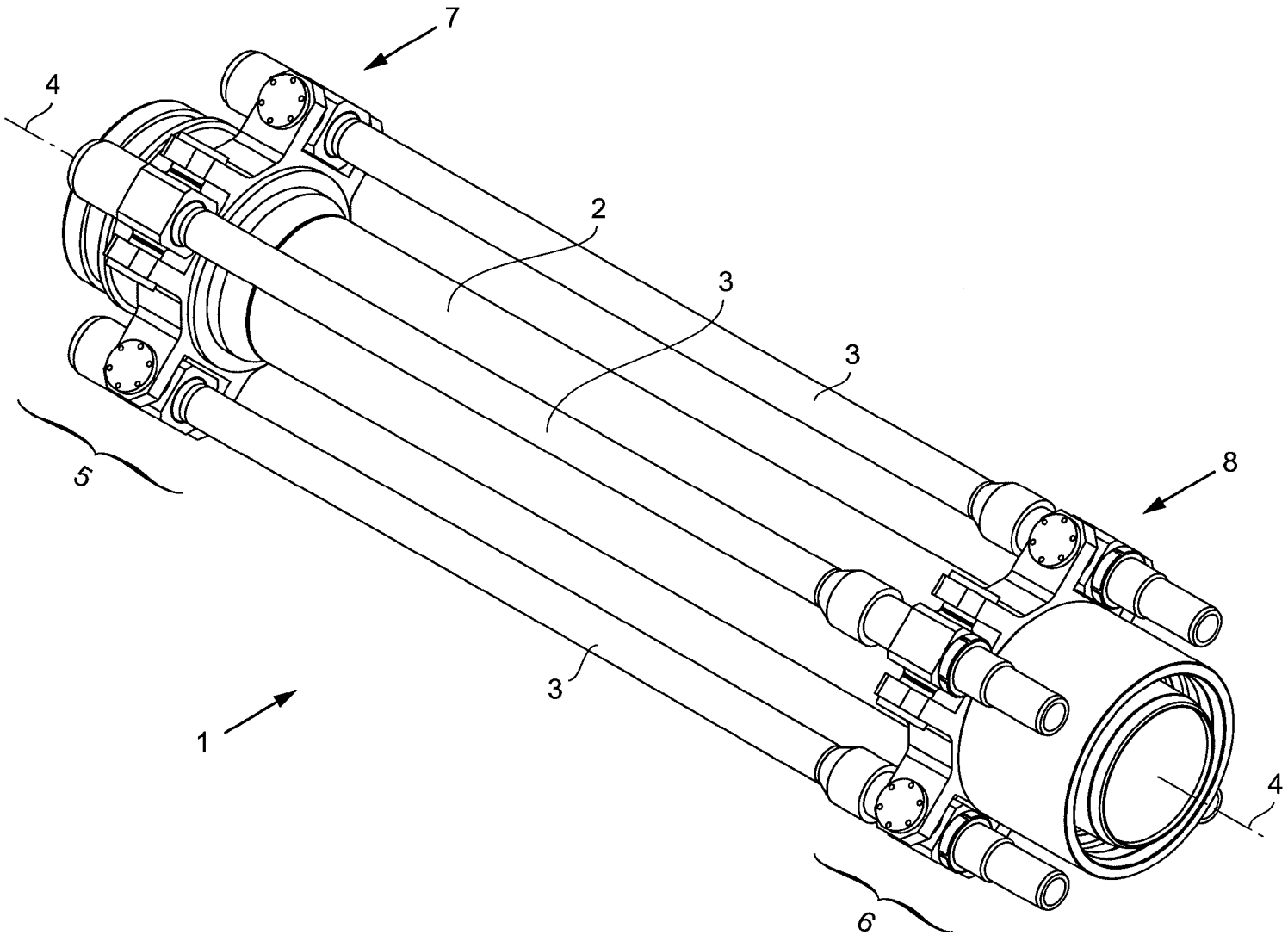
FIGS. 1 and 2 show an auxiliary line section.

FIG. 1 shows a section 1 of a riser pipe. Section 1 is provided, at one end thereof, with female connecting means 5 and, at the other end, with male connecting means 6. To form a riser, several sections 1 are assembled end to end using connecting means 5 and 6.

Riser section 1 comprises a main tube element 2 whose axis 4 is the axis of the riser. The auxiliary lines or pipes are arranged parallel to axis 4 of the riser so as to be integrated in the main tube. Reference numbers 3 designate each of the auxiliary line elements. The length of elements 3 is substantially equal to the length of main tube element 2. At least one line 3 is arranged on the periphery of main tube 2. These lines, called kill line, choke line, are used to provide well safety during control procedures intended to check the inflow of fluids under pressure in the well. The booster line allows mud to be injected. The hydraulic line allows the blowout preventer, commonly referred to as B.O.P., to be controlled at the wellhead.

Female and male connecting means 5 and 6 consist of a mechanical connector mounted on the ends of main tube element 2, and of subs mounted on the ends of auxiliary line elements 3. The mechanical connector transmits stresses from one riser section to the next section, notably the tensional stresses undergone by the riser. On the other hand, the subs do not transmit longitudinal stresses.

For example, the mechanical connector can be of the type described in documents FR-2,432,672, FR-2,464,426 and FR-2,526,517. These connectors allow two tube sections to be assembled together. A connector comprises a male tubular element and a female tubular element that fit into one another and have an axial shoulder for longitudinal positioning of the male tubular element in relation to the female tubular element. The connector also comprises a locking ring mounted mobile in rotation on one of the tubular elements. The ring comprises studs that co-operate with the studs of the other tubular element so as to form a bayonet joint.

The subs allow two auxiliary line elements 3 to be connected. A sub consists of a male end piece located at one end of element 3 and of a female end piece located at the other end of element 3. A male end piece of an element 3 co-operates tightly with the female end piece of another element 3. For example, the male element of the sub is a tube that fits into another tube making up the female element, the inner surface of the female tube being adjusted to the outer surface of the male tube. Joints are mounted in slots machined on the inner surface of the female element so as to provide a sealed connection. The sub allows radial displacement of one of elements 3 in relation to the other while maintaining a sealed connection between the two elements.

According to the invention, auxiliary line element 3 is firmly linked at each end thereof to main tube 2. In other words, riser section 1 comprises at each end thereof fastening means 7 and 8 allowing auxiliary line element 3 to be axially connected to main tube 2. Fastening means 7 and 8 allow longitudinal stresses to be transmitted from the main tube to elements 3. Thus, these fastening means 7 and 8 allow the tensional stresses applied to each riser section to be distributed in the main tube and in the auxiliary line elements.

According to the invention, at least one of fastening means 7 and 8 stops in translation auxiliary line element 3 in relation to main tube 2 and leaves at least a rotating motion freedom. Fastening means 7 and 8 can allow rotation of element 3 in relation to tube 2 along an axis perpendicular to axis 4 of the riser, more precisely along an axis perpendicular to the plane passing through the axis of the main tube and of the auxiliary line. Owing to the rotation mobility of element 3 in relation to tube 2, fastening means 7 or 8 can undergo bending strains without passing bending stresses on to auxiliary line elements 3.

For example, fastening means 7 and 8 can consist of a knuckle joint. This knuckle joint allows any rotating motion but it stops any translation motion of auxiliary line element 3 in relation to tube 2.

Figure 3:
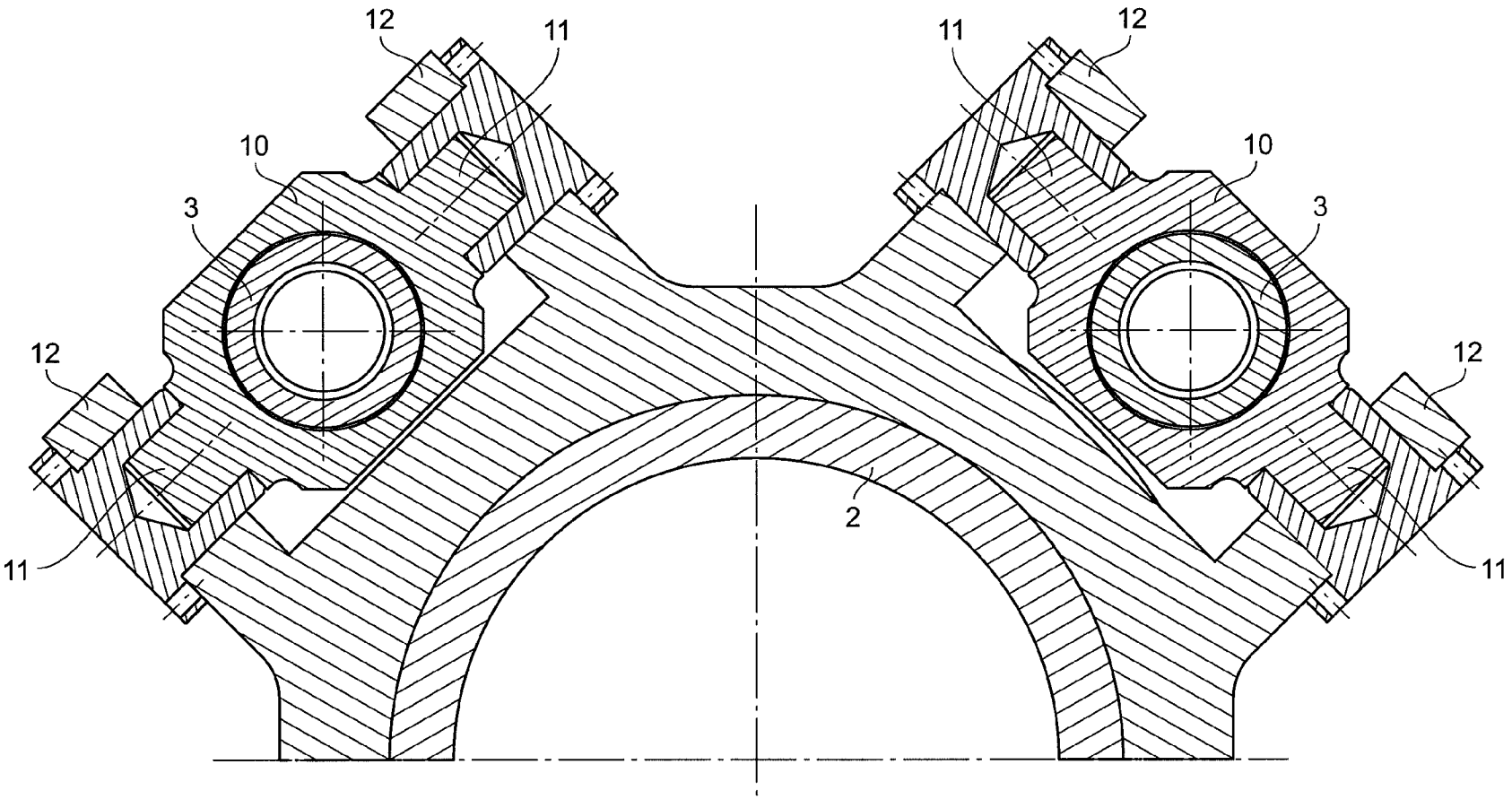
FIG. 3 diagrammatically shows in detail a journal.

In FIG. 1, element 3 is provided at each end thereof with fastening means 7 and 8 consisting of a journal that allows a rotating motion of element 3. In reference to FIG. 3, the journal consists, on the one hand, of a ring 10 provided with two pivots 11, two coaxial shafts for example, and on the other hand of a fork 12 pierced with two coaxial holes. The ring is firmly mounted on element 3, for example by screwing, clamping or welding. Fork 12 is firmly mounted on main tube 2, for example by screwing, clamping or welding. The fork is positioned on the periphery of main tube 2, the two holes extending along an axis perpendicular to axis 4 of the main tube. The two shafts 11 respectively fit into the holes of fork 12 acting as bracket bearings in which the shafts rotate. Thus, element 3 can pivot in relation to main tube 2 along the axis of the two shafts of the ring. On the other hand, the tensional stresses applied along the axis of the riser are transmitted from connecting means 5 or 6 to element 3 by means of the fork and of the two shafts of the ring. This type of assembly allows to transmit from main tube 2 to element 3 tensional stresses that can exceed 200 tons.

Figure 2:
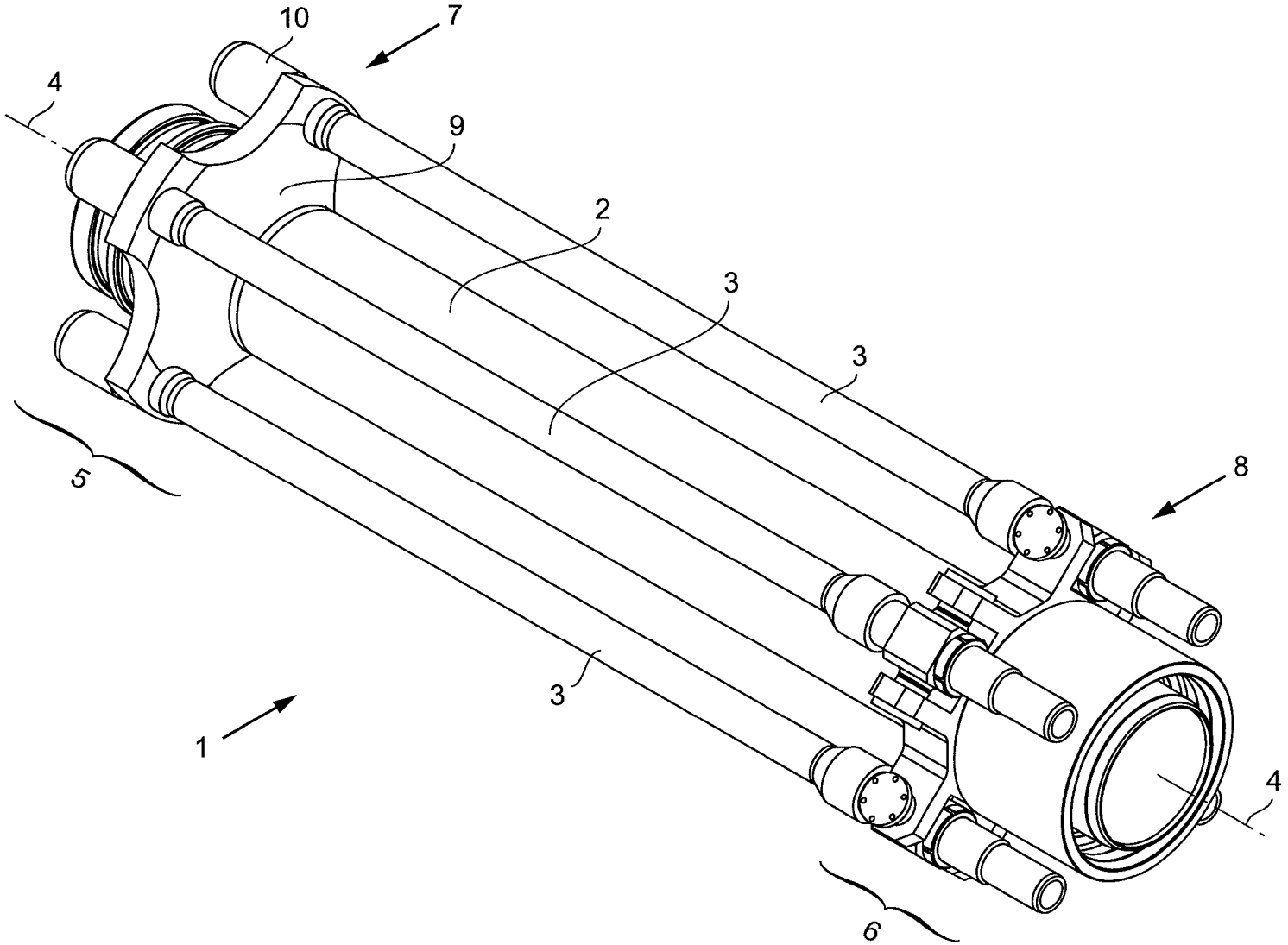

FIG. 2 shows a riser section comprising two different types of means for fastening element 3 to main tube 2: a stiff fastening means 7 and a fastening means 8 allowing a rotating motion. Fastening means 7 consists of a stiff fastening made up of flange 9 and of a stop 10 provided on element 3. When the riser section is under tension, stop 10 comes into contact with flange 9 so as to form a stiff connection. Fastening means 8 consists of journals as described above.

Fastening means 7 and 8 mounted at both ends of element 3 stop in translation the ends of element 3 on main tube 2. Thus, when the riser is under tension, for example under the effect of the own weight of the riser or under the action of a tensioner during drilling operations, the tensional stresses undergone by a riser section are distributed in the main tube and in each auxiliary line element, in proportion to the steel sections.

Furthermore, according to the invention, at least one of fastening means 7 and 8 mounted at both ends of element 3 allows rotation of element 3 at the fastening point about an axis perpendicular to axis 4 of the riser. Thus, these fastening means can withstand a bending strain without modifying the rectilinear shape of the auxiliary line elements. In other words, elements 3 can remain parallel to the axis of main tube 2 whereas the parts and supports of fastening means 7 and 8 bend under the load generated by the tensional stresses in the riser.

By way of example, a riser according to the invention can have the characteristics as follows:

Main tube diameter: 21"

Auxiliary line diameter: 6"

Working pressure: 1050 bars

Tensional stresses exerted on the riser: 1000 tons.

Furthermore, in order to produce risers that can operate at depths reaching 3500 m and more, metallic tube elements are used, whose resistance is optimized by composite hoops made of fibers coated with a polymer matrix.

A tube hooping technique can be the technique consisting in winding under tension composite strips around a metallic tubular body, as described in documents FR-2,828,121, FR-2,828,262 and U.S. Pat. No. 4,514,254.

The strips consist of fibers, glass, carbon or aramid fibers for example, the fibers being coated with a polymer matrix, thermoplastic or thermosetting, such as a polyamide.

A technique known as self-hooping can also be used, which consists in creating the hoop stress during hydraulic testing of the tube at a pressure causing the elastic limit in the metallic body to be exceeded. In other words, strips made of a composite material are wound around the tubular metallic body. During the winding operation, the strips induce no stress or only a very weak stress in the metallic tube. Then a predetermined pressure is applied to the inside of the metallic body so that the metallic body deforms plastically. After return to a zero pressure, residual compressive stresses remain in the metallic body and tensile stresses remain in the composite strips.

The thickness of the composite material wound around the metallic tubular body, preferably made of steel, is determined according to the hoop prestress required for the tube to withstand, according to the state of the art, the pressure and tensional stresses.

The invention claimed is:

1. A riser section comprising a main tube, at least one auxiliary line element substantially parallel to said main tube, and at least two fastening means joining the ends of said element to said main tube, characterized in that the fastening means allow longitudinal stresses to be transmitted from said at least one auxiliary line element to said main tube and in that at least one of the fastening means comprises a knuckle joint that allows at least a rotating motion of said at least one auxiliary line element in relation to said main tube, the rotating motion following an axis perpendicular to the plane passing through the axis of said main tube and through the axis of said at least one auxiliary line element.

2. A riser section as claimed in claim 1, wherein each of the two fastening means allows at least a rotating motion of said at least one auxiliary line element in relation to said main tube, the rotating motion following an axis perpendicular to the plane passing through the axis of said main tube and through the axis of said at least one auxiliary line element.

3. A riser section as claimed in claim 1, wherein the main tube is a steel tube hooped with composite strips.

4. A riser section as claimed in claim 1, wherein the auxiliary line element is a steel tube hooped with composite strips.

5. A riser section as claimed in claim 3, wherein said composite strips comprise glass, carbon or aramid fibers coated with a polymer matrix.

6. A riser section as claimed in claim 4, wherein said composite strips comprise glass, carbon or aramid fibers coated with a polymer matrix.

7. A riser section comprising a main tube, at least one auxiliary line element substantially parallel to said main tube, and at least two fastening means joining the ends of said element to said main tube, characterized in that the fastening means allow longitudinal stresses to be transmitted from said at least one auxiliary line element to said main tube and in that at least one of the fastening means comprises a pivot joint comprising a fork secured to said main tube, said fork comprising two bearings, said at least one auxiliary line element comprising two coaxial shafts co-operating with said two bearings.

8. A riser section as claimed in claim 7, wherein the main tube is a steel tube hooped with composite strips.

9. A riser section as claimed in claim 7, wherein the auxiliary line element is a steel tube hooped with composite strips.

10. A riser section as claimed in claim 8, wherein said composite strips comprise glass, carbon or aramid fibers coated with a polymer matrix.

11. A riser section as claimed in claim 9, wherein said composite strips comprise glass, carbon or aramid fibers coated with a polymer matrix.

12. A riser section as claimed in claim 7, wherein each of the two fastening means allows at least a rotating motion of said at least one auxiliary line element in relation to said main tube, the rotating motion following an axis perpendicular to the plane passing through the axis of said main tube and through the axis of said at least one auxiliary line element.

* * * * *